US009804518B2

(12) United States Patent
Matsumoto et al.

(10) Patent No.: US 9,804,518 B2
(45) Date of Patent: Oct. 31, 2017

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Akira Matsumoto, Kanagawa (JP); Shinya Nakashima, Kanagawa (JP); Masaki Iwase, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/937,929

(22) Filed: Nov. 11, 2015

(65) Prior Publication Data

US 2016/0370725 A1 Dec. 22, 2016

(30) Foreign Application Priority Data

Jun. 19, 2015 (JP) ..... 2015-124095

(51) Int. Cl.
*G03G 9/09* (2006.01)
*G03G 9/087* (2006.01)
*G03G 9/08* (2006.01)

(52) U.S. Cl.
CPC ..... *G03G 9/091* (2013.01); *G03G 9/0819* (2013.01); *G03G 9/08755* (2013.01)

(58) Field of Classification Search
CPC ..... G03G 9/091
See application file for complete search history.

(56) References Cited

U.S. PATENT DOCUMENTS 6,667,140 B2 * 12/2003 Tosaka ..... G03G 5/0609 430/108.23
6,933,092 B2 * 8/2005 Yoshida ..... G03G 9/0819 430/108.23
6,996,358 B2 * 2/2006 Ayaki ..... G03G 9/0821 430/107.1
2002/0058193 A1 5/2002 Tosaka et al.
2011/0177441 A1 * 7/2011 Vanbesien ..... G03G 9/08706 430/107.1
2011/0177442 A1 * 7/2011 Vanbesien ..... G03G 9/0804 430/107.1
2013/0157188 A1 * 6/2013 Kmiecik-Lawrynowicz ..... G03G 9/0806 430/107.1

FOREIGN PATENT DOCUMENTS

JP 2000248191 A * 9/2000
JP 2003-149869 A 5/2003
JP 2005107147 A * 4/2005
JP 2008304648 A * 12/2008

OTHER PUBLICATIONS

Aoki, T. Chemical Toner Technology and the Future. IS&T's NIP19: International Conference on Digital Printing Technologies. 2003, 2-4.*
English language machine translation of JP 2008-304648 (Dec. 2008).*

* cited by examiner

*Primary Examiner* — Christopher Rodee
(74) *Attorney, Agent, or Firm* — Sughrue Mion, PLLC

(57) ABSTRACT

An electrostatic charge image developing toner includes toner particles containing a binder resin, a colorant, and 5'-chloro-3-hydroxy-2'-methoxy-2-naphthanilide, wherein the colorant contains at least one of Pigment Red 238 and Pigment Red 269, the content of the colorant is from 1% by weight to 20% by weight, and the content of 5'-chloro-3-hydroxy-2'-methoxy-2-naphthanilide is from 1 ppm to 300 ppm based on the weight.

17 Claims, 3 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-124095 filed Jun. 19, 2015.

BACKGROUND

1. Technical Field

The present invention relates to an electrostatic charge image developing toner, an electrostatic charge image developer, and a toner cartridge.

2. Related Art

In recent years, an electrophotographic process has not only been used in a copying machine, but has also been widely used in a network printer in an office, a printer of a personal computer, a printer for print on demand, and the like according to the development of devices or improvement of a communication network in the information society, and not only black and white and color printing, but realization of high quality, high speed, high reliability, size reduction, light weight, and energy savings has been more strongly required.

In the electrophotographic process, a fixed image is generally formed through plural steps of electrically forming an electrostatic charge image on a photoreceptor (image holding member) using a photoconductive substance, with various units, developing this electrostatic charge image using a developer containing a toner, transferring a toner image on the photoreceptor to a recording medium such as paper through an intermediate transfer member or directly, and fixing this transferred image onto the recording medium.

SUMMARY

According to an aspect of the invention, there is provided an electrostatic charge image developing toner including toner particles containing:

a binder resin;

a colorant; and

5'-chloro-3-hydroxy-2'-methoxy-2-naphthanilide, wherein the colorant contains at least one of Pigment Red 238 and Pigment Red 269, a content of the colorant is from 1% by weight to 20% by weight, and a content of 5'-chloro-3-hydroxy-2'-methoxy-2-naphthanilide is from 1 ppm to 300 ppm based on the weight.

BRIEF DESCRIPTION OF THE DRAWINGS

Exemplary embodiments of the present invention will be described in detail based on the following figures, wherein.

DETAILED DESCRIPTION

Figure 1:
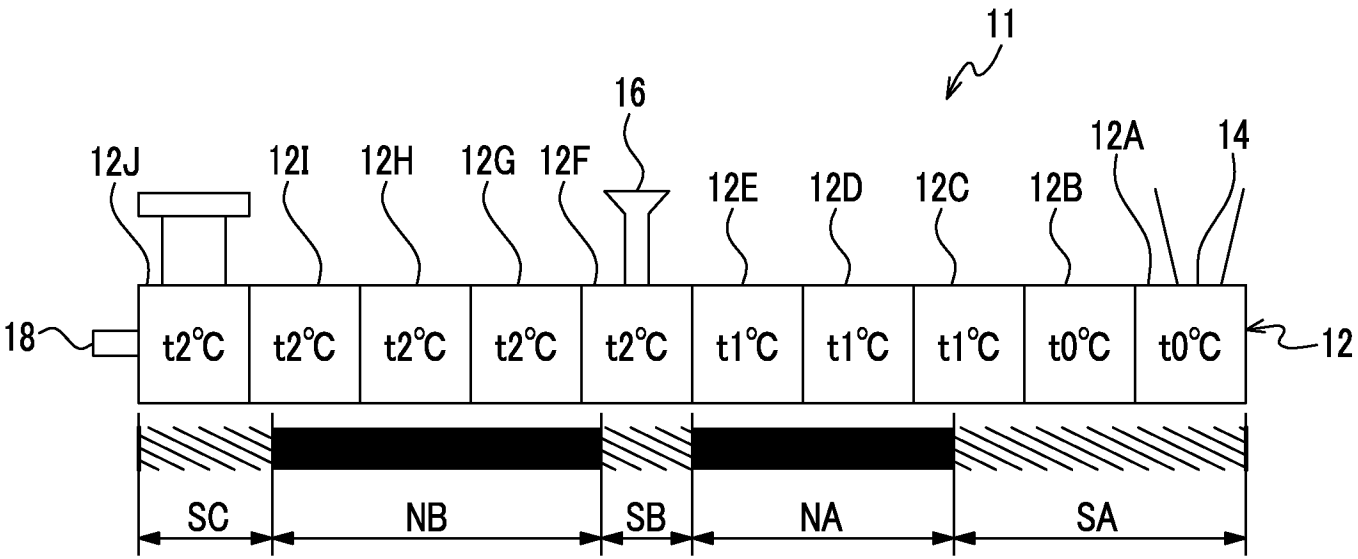
FIG. 1 is a diagram illustrating a screw state of an example of a screw extruder used in preparing a toner according to an exemplary embodiment.

Hereinafter, exemplary embodiments of an electrostatic charge image developing toner, an electrostatic charge image developer, a toner cartridge, a process cartridge, an image forming apparatus, and an image forming method will be described in detail.

Electrostatic Charge Image Developing Toner

An electrostatic charge image developing toner of the exemplary embodiment (hereinafter, the electrostatic charge image developing toner may be referred to as a "toner") contains a binder resin, a colorant, and 5'-chloro-3-hydroxy-2'-methoxy-2-naphthanilide, the colorant contains at least one of Pigment Red 238 and Pigment Red 269, the content of the colorant is from 1% by weight to 20% by weight, and the content of 5'-chloro-3-hydroxy-2'-methoxy-2-naphthanilide is from 1 ppm to 300 ppm based on the weight.

A toner image formed using the toner of the exemplary embodiment has excellent anti-crease performance. A reason why the toner image formed using the toner of the exemplary embodiment has excellent anti-crease performance is not clear, but the followings are assumed.

In recent years, a toner image is printed to cardboard by an electrophotographic method and a test for using the cardboard on which the toner image is formed as a package is started. When using the cardboard on which the toner image is formed as a package, a process such as folding may be performed on the cardboard, and accordingly, intensity required for the toner image is increased further than that in the related art. Accordingly, it is necessary to improve image intensity of the toner image based on a viewpoint other than the binder resin.

The inventors have found that image defects occur in an interface between an aggregated pigment and the binder resin, when the cardboard or the like on which the toner image is formed is folded, from observation results of the folded portion of the toner image. Therefore, in order to improve the image intensity of the toner image, it is necessary to have a more excellent pigment dispersion state in the toner.

As a result of the researches by the inventors, the inventors have found that a more excellent pigment dispersion state in the toner is obtained by containing a predetermined amount of 5'-chloro-3-hydroxy-2'-methoxy-2-naphthanilide in the toner, when at least one of Pigment Red 238 and Pigment Red 269 is used as the colorant.

That is, 5'-chloro-3-hydroxy-2'-methoxy-2-naphthanilide is a molecule having a high polarity and low molecular weight. Accordingly, when using 5'-chloro-3-hydroxy-2'-methoxy-2-naphthanilide when preparing the toner by a wet preparation method, for example, the molecules of 5'-chloro-3-hydroxy-2'-methoxy-2-naphthanilide repel each other to be more evenly dispersed in the toner.

The structure of 5'-chloro-3-hydroxy-2'-methoxy-2-naphthanilide is similar to a part of the structure of Pigment Red 238 or Pigment Red 269. Accordingly, Pigment Red 238 or Pigment Red 269 has a high affinity with 5'-chloro-3-hydroxy-2'-methoxy-2-naphthanilide and Pigment Red 238 or Pigment Red 269 easily approaches 5'-chloro-3-hydroxy-2'-methoxy-2-naphthanilide.

As a result, Pigment Red 238 or Pigment Red 269 approaches 5'-chloro-3-hydroxy-2'-methoxy-2-naphthanilide which is more evenly dispersed in the toner, and accordingly, Pigment Red 238 or Pigment Red 269 is easily more evenly dispersed in the toner.

It is assumed that, when Pigment Red 238 or Pigment Red 269 is more evenly dispersed in the toner, image intensity of a toner image is improved and a toner image having excellent anti-crease performance is formed.

Hereinafter, the toner according to the exemplary embodiment will be described in detail.

The toner according to the exemplary embodiment contains toner particles, and if necessary, an external additive.

Toner Particles

The toner particles, for example, contain a binder resin, a colorant, 5'-chloro-3-hydroxy-2'-methoxy-2-naphthanilide, and if necessary, a release agent, and other additives.

Binder Resin

Examples of the binder resins include a vinyl resin formed of a homopolymer consisting of monomers such as styrenes (for example, styrene, p-chlorostyrene, α-methyl styrene, or the like), (meth) acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These binder resins may be used singly or in combination with two or more kinds thereof.

As the binder resin, a polyester resin is preferable.

As the polyester resin, a well-known polyester resin is used, for example.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid having a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol having a crosslinked structure or a branched structure may be used in combination together with a diol. Examples of the tri- or higher-valent polyol include glycerin, trimethylolpropane, and pentaerythritol.

The polyols may be used singly or in combination of two or more kinds thereof.

The glass transition temperature (Tg) of the polyester resin is preferably from 50° C. to 80° C., and more preferably from 50° C. to 65° C.

The glass transition temperature is determined by a DSC curve obtained by differential scanning calorimetry (DSC), and more specifically, is determined by "extrapolating glass transition starting temperature" disclosed in a method of obtaining the glass transition temperature of JIS K-7121-1987 "Testing Methods for Transition Temperature of Plastics".

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

Further, the weight average molecular weight and the number average molecular weight are measured by gel permeation chromatography (GPC). The molecular weight measurement by GPC is performed using HLC-8120 GPC manufactured by Tosoh Corporation as a measuring device as a GPC, TSK gel Super HM-M (15 cm) manufactured by Tosoh Corporation as a column, and a THF solvent. The weight average molecular weight and the number average molecular weight are calculated using a molecular weight calibration curve created from a monodisperse polystyrene standard sample from the results of the above measurement.

A known preparing method is applied to prepare the polyester resin. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is, for example, preferably from 40% by weight to 95% by weight, more preferably from 50% by weight to 90% by weight, and still more preferably from 60% by weight to 85% by weight, with respect to the entire toner particles.

Colorant

As the colorant used in the exemplary embodiment, at least one of Pigment Red 238 and Pigment Red 269 is used. In the exemplary embodiment, colorant other than Pigment Red 238 and Pigment Red 269 may be used in combination.

Examples of the other colorant include pigments such as carbon black, chrome yellow, Hansa yellow, benzidine yellow, threne yellow, quinoline yellow, pigment yellow, permanent orange GTR, pyrazolone orange, vulcan orange, watch young red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used singly or in combination of two or more kinds thereof.

If necessary, a surface-treated colorant may be used as the colorant, and the colorant may be used in combination with a dispersant. Further, a combination of plural kinds of the colorants may be used.

The content of the colorant is from 1% by weight to 20% by weight, preferably from 2% by weight to 15% by weight, and more preferably from 3% by weight to 10% by weight. When the content of the colorant is smaller than 1% by weight, the density of the toner image may be insufficient. When the content of the colorant exceeds 20% by weight, charging properties of the toner may be decreased and density of a half-tone image may be decreased to deteriorate gradation properties.

In the embodiment, the rate of the content of Pigment Red 238 and Pigment Red 269 occupying the colorant is preferably from 50% by weight to 100% by weight, more preferably from 60% by weight to 100% by weight, and even more preferably from 70% by weight to 100% by weight.

The content of Pigment Red 238 and Pigment Red 269 in the exemplary embodiment is a value measured by the following method.

Pigment Red 238 and Pigment Red 269 contain chlorine as a pigment constituent element and the content of Pigment Red 238 and Pigment Red 269 in the toner is determined with a calibration curve of which chlorine intensity is previously measured using an X-ray fluorescence spectrometer (XRF). Specifically, a disc having a diameter of 5 cm is prepared by applying compression pressure of 10 ton to 5 g of toner particles using a pressure molding device and this is set as a measurement sample. The chlorinity in the toner is measured using an X-ray fluorescence spectrometer (XRF-1500) manufactured by Shimadzu Corporation and setting the measurement conditions to have a tube voltage of 40 kV, tube current of 90 mA, and measurement time of 30 minutes.

5'-Chloro-3-Hydroxy-2'-Methoxy-2-Naphthanilide

The content of 5'-chloro-3-hydroxy-2'-methoxy-2-naphthanilide of the toner according to the exemplary embodiment is from 1 ppm to 300 ppm, preferably from 5 ppm to 200 ppm, and more preferably from 10 ppm to 100 ppm based on the weight. When the content of 5'-chloro-3-hydroxy-2'-methoxy-2-naphthanilide is smaller than 1 ppm, dispersibility of the colorant may be decreased and anti-crease performance of the toner image may be deteriorated. When the content of 5'-chloro-3-hydroxy-2'-methoxy-2-naphthanilide exceeds 300 ppm, charging properties of the toner may be decreased and density of a half-tone image may be decreased to cause deterioration in gradation properties.

The content of 5'-chloro-3-hydroxy-2'-methoxy-2-naphthanilide of the exemplary embodiment is a value measured by the following method.

The content of 5'-chloro-3-hydroxy-2'-methoxy-2-naphthanilide in the toner is determined with a calibration curve which is obtained by previously performing measurement regarding 5'-chloro-3-hydroxy-2'-methoxy-2-naphthanilide using liquid chromatography (LC-UV). Specifically, 0.05 g of the toner is weighed, tetrahydrofuran is added thereto, and ultrasonic extraction is performed for 30 minutes. After that, a solution obtained by collecting an extract and adjusting an amount of the extract to exactly 20 mL using acetonitrile is set as a sample solution, and the measurement is performed by liquid chromatography (LC-UV).

3-Amino-4-Methoxybenzanilide

The toner according to the exemplary embodiment may contain 3-amino-4-methoxybenzanilide. 3-amino-4-methoxybenzanilide is a low-molecular-weight molecule having high polarity. Accordingly, when using 3-amino-4-methoxybenzanilide when preparing a toner by a wet preparation method, for example, molecules of 3-amino-4-methoxybenzanilide are repel each other to be easily more evenly dispersed in the toner.

The structure of 3-amino-4-methoxybenzanilide is similar to a part of the structure of Pigment Red 238 or Pigment Red 269. Accordingly, Pigment Red 238 or Pigment Red 269 has a high affinity with 3-amino-4-methoxybenzanilide and Pigment Red 238 or Pigment Red 269 easily approaches 3-amino-4-methoxybenzanilide.

As a result, Pigment Red 238 or Pigment Red 269 approaches 3-amino-4-methoxybenzanilide which is more evenly dispersed in the toner, and accordingly, Pigment Red 238 or Pigment Red 269 is easily more evenly dispersed in the toner.

It is assumed that, when Pigment Red 238 or Pigment Red 269 is more evenly dispersed in the toner, image intensity of a toner image is improved and a toner image having excellent anti-crease performance is formed.

The content of 3-amino-4-methoxybenzanilide of the toner according to the exemplary embodiment is preferably from 1 ppm to 1,000 ppm, more preferably from 5 ppm to 800 ppm, and even more preferably from 10 ppm to 500 ppm based on the weight.

The content of 3-amino-4-methoxybenzanilide of the exemplary embodiment is a value measured by the following method.

The content of 3-amino-4-methoxybenzanilide in the toner is determined with a calibration curve which is obtained by previously performing measurement regarding 3-amino-4-methoxybenzanilide using liquid chromatography (LC-UV). Specifically, 0.05 g of the toner is weighed, tetrahydrofuran is added thereto, and ultrasonic extraction is performed for 30 minutes. After that, a solution obtained by collecting an extract and adjusting an amount of the extract to exactly 20 mL using acetonitrile is set as a sample solution, and the measurement is performed by liquid chromatography (LC-UV).

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

Further, the melting temperature is determined from a DSC curve obtained by differential scanning calorimetry (DSC), using the "melting peak temperature" described in the method of determining a melting temperature in the "Testing Methods for Transition Temperature of Plastics" in JIS K-7121-1987.

The content of the release agent is, for example, preferably from 1% by weight to 20% by weight, and more preferably from 5% by weight to 15% by weight, with respect to the entire toner particles.

Other Additives

Examples of other additives include known additives such as a magnetic material, a charge-controlling agent, and an inorganic powder. These additives are included as internal additives in the toner particles.

Characteristics of Toner Particles

The toner particles may be toner particles having a single layer structure, or toner particles having a so-called core-shell structure composed of a core (core particle) and a coating layer (shell layer) that is coated on the core.

Here, the toner particles having a core-shell structure may preferably be composed of, for example, a core configured to include a binder resin, a colorant, 5'-chloro-3-hydroxy-2'-methoxy-2-naphthanilide, and other additives such as a release agent, and a coating layer configured to include a binder resin.

The volume average particle diameter (D50v) of the toner particles is preferably from 2 μm to 10 μm and more preferably from 4 μm to 8 μm.

Various average particle diameters and various particle diameter distribution indexes of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of a surfactant (preferably sodium alkylbenzene sulfonate) as a dispersant. The obtained material is added to 100 ml to 150 ml of the electrolyte.

The electrolyte in which the sample is suspended is subjected to a dispersion treatment using an ultrasonic disperser for 1 minute, and a particle diameter distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle diameter ranges (channels) divided based on the measured particle diameter distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a cumulative number average particle diameter D50p. Furthermore, the particle diameter when the cumulative percentage becomes 84% is defined as that corresponding to a volume particle diameter D84v and a number particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

The shape factor SF1 of the toner particles is preferably from 110 to 150, and more preferably from 120 to 140.

Furthermore, the shape factor SF1 is determined by the following equation:

$$SF1=(ML^2/A)\times(\pi/4)\times 100 \quad \text{Equation}$$

In the equation, ML represents an absolute maximum length of a toner and A represents a projected area of a toner.

Specifically, the shape factor SF1 is digitalized by analysing mainly a microscopic image or an image of a scanning electron microscope (SEM) using an image analyzer and calculated as follows. That is, an optical microscopic image of particles sprayed on the surface of a glass slide is captured into an image analyzer LUZEX through a video camera, the maximum lengths and the projected areas of 100 particles are obtained for calculation using the above-described equation, and an average value thereof is obtained.

The viscosity of the toner according to the exemplary embodiment at 100° C. is preferably from 5,000 Pa·s to 50,000 Pa·s, more preferably from 6,000 Pa·s to 40,000 Pa·s, and even more preferably from 7,000 Pa·s to 30,000 Pa·s.

When the viscosity at 100° C. is from 5,000 Pa·s to 50,000 Pa·s, the dispersibility of Pigment Red 238 or Pigment Red 269 in the toner particles is improved, when preparing the toner particles by the wet preparation method.

External Additives

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Among these, it is preferable to use sol-gel silica prepared by a sol-gel method, as the inorganic particles, from a viewpoint of charging stability.

It is preferable that the surfaces of the inorganic particles as the external additive are subjected to a treatment with a hydrophobizing agent. For example, the hydrophobization treatment is performed, by immersing the inorganic particles in a hydrophobizing agent. The hydrophobization treatment agent is not particularly limited and examples thereof include a silane coupling agent, silicone oil, a titanate coupling agent and an aluminum coupling agent. These may be used singly or in combination of two or more kinds thereof.

For example, the amount of the hydrophobization treatment agent is from 1 part by weight to 10 parts by weight with respect to 100 parts by weight of the inorganic particles.

Examples of the external additives also include resin particles (resin particles such as polystyrene, polymethyl methacrylate (PMMA), and a melamine resin) and cleaning aids (for example, a metal salt of higher fatty acid represented by zinc stearate and a particle of a fluorine polymer).

The amount of the external additive externally added is, for example, preferably from 0.01% by weight to 5% by weight, and more preferably from 0.01% by weight to 2.0% by weight, with respect to the toner particles.

Method of Preparing Toner

Next, a method for preparing the toner according to the exemplary embodiment will be described.

The toner according to the exemplary embodiment is obtained by preparing toner particles and then externally adding an external additive to the toner particles.

The toner particles may be prepared, by any of a dry preparation method (for example, kneading and pulverizing method) and a wet preparation method (for example, an aggregation and coalescence method, a suspension polymerization method, and a dissolution suspension method). The method of preparing the toner particles is not limited thereto and a known method may be employed.

Among these, the toner particles are preferably obtained by an aggregation and coalescence method.

Specifically, for example, in the case where the toner particles are prepared using the aggregation and coalescence method, the toner particles are prepared through:

a step of preparing a resin particle dispersion in which resin particles which become a binder resin are dispersed (resin particle dispersion preparing step);

a step of forming aggregated particles by aggregating the resin particle (as necessary, other particles) in the resin particle dispersions (as necessary, in the dispersion after other particle dispersion is mixed) (aggregated particle forming step); and a step of forming toner particles by heating the aggregated particle dispersion in which the aggregated particles are dispersed to coalesce the aggregated particles (coalescence step).

5'-chloro-3-hydroxy-2'-methoxy-2-naphthanilide may be added into the dispersion in the aggregated particle forming step.

Hereafter, the details on each of the steps will be described.

Further, while a method of obtaining toner particles containing a release agent will be described in the following description, the release agent is used, as necessary. Additional additives other than the release agent may, of course, be used.

Resin Particle Dispersion Preparing Step

First, along with a resin particle dispersion in which resin particles which become a binder resin are dispersed, for example, a colorant particle dispersion in which colorant particles are dispersed, and a release agent particle dispersion in which release agent particles are dispersed are prepared.

Here, the resin particle dispersion is prepared, for example, by dispersing resin particles in a dispersion medium by a surfactant.

An example of the dispersion medium used in the resin particle dispersion includes an aqueous medium.

Examples of the aqueous medium include water such as distilled water and ion exchange water, and alcohols and the like. These may be used singly or in combination of two or more kinds thereof.

Examples of the surfactant include anionic surfactants such as sulfuric ester salts, sulfonates, phosphoric esters and soap surfactants; cationic surfactants such as amine salts and quaternary ammonium salts; and nonionic surfactants such as polyethylene glycol, an ethylene oxide adduct of an alkylphenol, and polyols. Among these, particularly, anionic surfactants and cationic surfactants are preferable. The nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a Dyno mill having media is exemplified. In addition, the resin particles may be dispersed in a resin particle dispersion, for example, by a phase inversion emulsification method depending on the types of the resin particles.

Incidentally, the phase inversion emulsification method is a method in which a resin to be dispersed is dissolved in a hydrophobic organic solvent capable of dissolving the resin, a base is added to the organic continuous phase (O phase) to neutralize the resin, an aqueous medium (W phase) is added to invert the resin into a discontinuous phase (so-caller inversed phase): from W/O to O/W, so that the resin may be dispersed in the form of particles in the aqueous medium.

The volume average particle diameter of the resin particles dispersed in the resin particle dispersions is preferably, for example, from 0.01 μm to 1 μm, more preferably from 0.08 μm to 0.8 μm, and even more preferably from 0.1 μm to 0.6 μm.

In addition, the volume average particle diameter of the resin particles is measured such that by using the particle diameter distribution measured by a laser diffraction particle diameter distribution analyzer (for example, LA-700, manufactured by Horiba Seisakusho Co., Ltd.), a cumulative distribution is drawn from the small diameter side with respect to the volume based on the divided particle diameter ranges (channels) and the particle diameter at which the cumulative volume distribution reaches 50% of the total particle volume is defined as a volume average particle diameter D50v. Further, the volume average particle diameter of particles in the other dispersion will be measured in the same manner.

For example, the content of the resin particles contained in the resin particle dispersion is preferably from 5% by weight to 50% by weight, and more preferably from 10% by weight to 40% by weight.

Moreover, for example, the colorant particle dispersion, and the release agent particle dispersion are prepared in a manner similar to the resin particle dispersion. That is, with respect to the dispersion medium, the dispersion method, the volume average particle diameter of the particles, and the content of the particles in the resin particle dispersion, the same is applied to the colorant particles dispersed in the colorant particle dispersion and the release agent particles dispersed in the release agent particle dispersion.

Aggregated Particle Forming Step

Next, the resin particle dispersion is mixed with the colorant particle dispersion, and the release agent particle dispersion. At that time, 5'-chloro-3-hydroxy-2'-methoxy-2-naphthanilide may be mixed therewith.

Further, in the mixed dispersion, the resin particles, the colorant particles, and the release agent particle are hetero-aggregated to form aggregated particles containing the resin particles, the colorant particles, and the release agent particles, which have a diameter close to a targeted particle diameter of the toner particles.

Specifically, for example, an aggregation agent is added to the mixed dispersion, and the pH of the mixed dispersion is adjusted to be acidic (for example, a pH ranging from 2 to 5). As necessary, a dispersion stabilizer is added thereto, followed by heating to the glass transition temperature of the resin particles (specifically, from the temperature 30° C. lower than the glass transition temperature of the resin particles to the temperature 10° C. lower than the glass transition temperature). The particles dispersed in the mixed dispersion are aggregated to form aggregated particles.

In the aggregated particle forming step, for example, the aggregation agent is added to the mixed dispersion while stirring using a rotary shear type homogenizer at room temperature (for example, 25° C.), and the pH of the mixed dispersion is adjusted to be acidic (for example, a pH ranging from 2 to 5). As necessary, a dispersion stabilizer may be added thereto, followed by heating.

Examples of the aggregation agent include a surfactant having a polarity opposite to the polarity of the surfactant used as the dispersant which is added to the mixed dispersion, for example, an inorganic metal salt and a divalent or higher-valent metal complex. In particular, when a metal complex is used as an aggregation agent, the amount of the surfactant used is reduced, which results in improvement of charging properties.

An additive for forming a complex or a similar bond with a metal ion in the aggregation agent may be used, as necessary. As the additive, a chelating agent is suitably used.

Examples of the inorganic metal salt include metal salts such as calcium chloride, calcium nitrate, barium chloride, magnesium chloride, zinc chloride, aluminum chloride, and aluminum sulfate, and polymers of inorganic metal salts such as polyaluminum chloride, polyaluminum hydroxide and calcium polysulfide.

As the chelating agent, a water-soluble chelating agent may be used. Examples of the chelating agent include oxycarboxylic acids such as tartaric acid, citric acid and gluconic acid, iminodiacetic acid (IDA), nitrilotriacetic acid (NTA), and ethylenediamine tetraacetic acid (EDTA).

The amount of the chelating agent added is, for example, preferably from 0.01 parts by weight to 5.0 parts by weight, and more preferably from 0.1 parts by weight to less than 3.0 parts by weight with respect to 100 parts by weight of the resin particles.

Aggregation and Coalescence Step

Next, the aggregated particles are coalesced by heating the aggregated particle dispersion in which the aggregated particles are dispersed up to, for example, a temperature equal to or higher than the glass transition temperature of the resin particles (for example, 10° C. to 30° C. higher than the glass transition temperature of the resin particles), thereby forming toner particles.

The toner particles are obtained by the above-described steps.

Further, the toner particles may also be prepared through a step in which after obtaining an aggregated particle dispersion in which the aggregated particles are dispersed, the aggregated particle dispersion is further mixed with a resin particle dispersion in which the resin particles are dispersed, and aggregation is performed to further adhere the resin particles onto the surface of the aggregated particles, thereby forming, second aggregated particles; and a step in which a second aggregated particle dispersion in which the second aggregated particles are dispersed is heated to coalesce the second aggregated particles, thereby forming toner particles having a core-shell structure.

Here, after completion of the aggregation and coalescence step, the dried toner particles are obtained by subjecting the toner particles formed in the solution to a washing step, a solid-liquid separation step, and a drying step, as known in the art.

The washing step may be preferably sufficiently performed by a replacement washing with ion exchange water in terms of charging properties. The solid-liquid separation step is not particularly limited but may be preferably performed by filtration under suction or pressure in terms of productivity. The drying step is not particularly limited but may be preferably performed by freeze-drying, flash jet drying, fluidized drying or vibration fluidized drying in terms of productivity.

The toner according to the exemplary embodiment is prepared by, for example, adding the external additive to the dry toner particles that have been obtained, followed by mixing. The mixing may preferably be performed with, for example, a V-blender, a Henschel mixer, a Lödige mixer, or the like. Furthermore, if necessary, coarse toner particles may be removed using a vibration sieving machine, a wind classifier, or the like.

A kneading and pulverizing method is a method of preparing toner particles by kneading a toner forming material containing a colorant, a binder resin, and 5'-chloro-3-hydroxy-2'-methoxy-2-naphthanilide to obtain a kneaded material and pulverizing the kneaded material.

More specifically, the kneading and pulverizing method is divided into a kneading step of kneading the toner forming material containing a colorant, a binder resin, and 5'-chloro-3-hydroxy-2'-methoxy-2-naphthanilide and a pulverizing step of pulverizing the kneaded material. If necessary, other steps such as a cooling step of cooling the kneaded material formed in the kneading step may be included.

Each step will be described in detail.

Kneading Step

In the kneading step, the toner forming material containing a colorant, a binder resin, and 5'-chloro-3-hydroxy-2'-methoxy-2-naphthanilide is kneaded.

In the kneading step, it is desired to add 0.5 parts by weight to 5 parts by weight of an aqueous medium (for example, water such as distilled water or ion exchange water, and alcohols) with respect to 100 parts by weight of toner forming material.

Examples of a kneading machine used in the kneading step include a single screw extruder, a twin screw extruder, and the like. Hereinafter, a kneading machine including a sending screw portion and two kneading portions will be described as an example of the kneading machine with reference to the drawing, but it is not limited thereto.

FIG. 1 is a diagram illustrating a screw state of an example of a screw extruder that is used in the kneading step of the method of preparing the toner of the exemplary embodiment.

A screw extruder 11 is constituted by a barrel 12 provided with a screw (not shown), an injection port 14 through which a toner forming material that is a raw material of the toner is injected to the barrel 12, a liquid addition port 16 for adding an aqueous medium to the toner forming material in the barrel 12, and a discharge port 18 through which the kneaded material formed by kneading the toner forming material in the barrel 12 is discharged.

In ascending order of distance from the injection port 14, the barrel 12 is divided into a sending screw portion SA which transports the toner forming material which is injected from the injection port 14 to a kneading portion NA, the kneading portion NA for melting and kneading the toner forming material by a first kneading step, a sending screw portion SB which transports the toner forming material which is melted and kneaded in the kneading portion NA to a kneading portion NB, the kneading portion NB which is for melting and kneading the toner forming material by a second kneading step to form a kneaded material, and a sending screw portion SC which transports the formed kneaded material to the discharge port 18.

In addition, in the barrel 12, a different temperature controller (not shown) is provided for each block. That is, the temperatures of blocks 12A to 12J may be controlled to be different from each other. FIG. 1 shows a state in which the temperatures of the blocks 12A and 12B are controlled to t0° C., the temperatures of the blocks 12C to 12E are controlled to t1° C., and the temperatures of the blocks 12F to 12J are controlled to t2° C. Therefore, the toner forming material in the kneading portion NA is heated to t1° C., and the toner forming material in the kneading portion NB is heated to t2° C.

When the toner forming material containing a binder resin, a colorant, 5'-chloro-3-hydroxy-2'-methoxy-2-naphthanilide, and, if necessary, a release agent is supplied to the barrel 12 from the injection port 14, the sending screw portion SA sends the toner forming material to the kneading portion NA. At this time, since the temperature of the block 12C is set to t1° C., the toner forming material melted by heating is fed to the kneading portion NA. In addition, since the temperatures of the blocks 12D and 12E are also set to t1° C., the toner forming material is melted and kneaded at a temperature of t1° C. in the kneading portion NA. The binder resin and the release agent are melted in the kneading portion NA and subjected to shearing with the screw.

Next, the toner forming material kneaded in the kneading portion NA is sent to the kneading portion NB by the sending screw portion SB.

In the sending screw portion SB, an aqueous medium is added to the toner forming material by injecting the aqueous medium, as necessary, to the barrel 12 from the liquid addition port 16. In FIG. 1, the aqueous medium is injected in the sending screw portion SB, but the invention is not limited thereto. The aqueous medium may be injected in the kneading portion NB, or may be injected in both of the sending screw portion SB and the kneading portion NB. That is, the position at which the aqueous medium is injected and the number of injection positions are selected as necessary.

As described above, due to the injection of the aqueous medium to the barrel 12 from the liquid addition port 16, the toner forming material in the barrel 12 and the aqueous medium are mixed, and the toner forming material is cooled by evaporative latent heat of the aqueous medium, whereby the temperature of the toner forming material is appropriately maintained.

Finally, the kneaded material formed by being melted and kneaded by the kneading portion NB is transported to the discharge port 18 by the sending screw portion SC, and is discharged from the discharge port 18.

By doing so, the kneading step using the screw extruder 11 shown in FIG. 1 is performed.

Cooling Step

The cooling step is a step of cooling the kneaded material which is formed in the kneading step, and in the cooling step, it is preferable to cool the kneaded material to 40° C. or lower from a temperature of the kneaded material at the time of completing the kneading step, at an average temperature falling rate of 4° C./sec or more. When the cooling rate of the kneaded material is slow, the mixture which is finely dispersed in the binder resin in the kneading step (a mixture of a colorant, 5'-chloro-3-hydroxy-2'-methoxy-2-naphthanilide, and the internal additive such as a release agent which is, if necessary, internally added to the toner particle) may be recrystallized and a dispersion diameter may become large. Meanwhile, it is preferable to perform rapid cooling at the average temperature falling rate, since the dispersed state immediately after completion of the kneading step is maintained as it is. The average temperature falling rate is an average value of a rate of the temperature falling from the temperature (for example, t2° C. when using the screw extruder 11 of FIG. 1) of the kneaded material at the time of completing the kneading step to 40° C.

In detail, as a cooling method of the cooling step, a method of using a rolling roll in which cold water or brine is circulated and an insert type cooling belt is used. When performing the cooling using the method described above, a cooling rate thereof is determined by a rate of the rolling roll, a flow rate of the brine, a supplied amount of the kneaded material, a slab thickness at the time of rolling the kneaded material, and the like. The slab thickness is preferably from 1 mm to 3 mm.

Pulverizing Step

The kneaded material cooled through the cooling step is pulverized through the pulverizing step to form toner particles. In the pulverizing step, for example, a mechanical pulverizer, a jet pulverizer or the like is used.

Classification Step

If necessary, the toner particles obtained through the pulverizing step may be classified through a classification step in order to obtain toner particles having a volume average particle diameter in a target range. In the classification step, a centrifugal classifier, an inertial classifier or the like, that have been used in the past, is used, and fine particles (toner particles having a particle diameter smaller than the target range) and coarse particles (toner particles having a particle diameter larger than the target range) are removed.

External Addition Step

Inorganic particles, represented by well-known silica, titania, and aluminum oxide, may be added and attached to the obtained toner particles for the purpose of adjusting charging properties, and imparting fluidity and charge exchange property, and the like. The external addition step is performed with, for example, a V-blender, a Henschel mixer, Lödige mixer or the like and may be performed through a few steps.

Sieving Step

If necessary, a sieving step may be provided after the above-described external addition step. Specifically, as a sieving method, for example, a gyro shifter, a vibrating sieving machine, a wind classifier or the like is used. Through sieving, coarse particles of the external additive and the like are removed, and thus the formation of streaks on the photoreceptor and trickling down contamination in the apparatus are prevented.

Next, a method of preparing toner particles by a dissolution suspension method will be described in detail.

The dissolution suspension method is a method of granulating a solution obtained by dissolving or dispersing a material containing a binder resin, a colorant, 5'-chloro-3-hydroxy-2'-methoxy-2-naphthanilide, and other compounds such as a release agent used as necessary, in a solvent in which the binder resin is dissoluble, in an aqueous medium containing an inorganic dispersant, and removing the solvent to obtain toner particles.

In addition to the release agent, examples of the other components used in the dissolution suspension method include various components such as an internal additive, a charge-controlling agent, inorganic powder (inorganic particles), and organic particles.

In the exemplary embodiment, the binder resin, the release agent, 5'-chloro-3-hydroxy-2'-methoxy-2-naphthanilide, and other components used as necessary, are dissolved or dispersed in a solvent in which the binder resin is dissoluble. Whether a binder resin dissolves in a solvent depends on constituent components of the binder resin, a molecular chain length, or a degree of three-dimensional shape, and is difficult to be unconditionally described. However, in general, examples of solvent include hydrocarbon such as toluene, xylene, or hexane, halogenated hydrocarbon such as methylene chloride, chloroform, dichloroethane, or dichloroethylene, alcohol or ether such as ethanol, butanol, benzyl alcohol ethyl ether, benzyl alcohol isopropyl ether, tetrahydrofuran, or tetrahydropyran, ester such as methyl acetate, ethyl acetate, butyl acetate, or isopropyl acetate, and ketone or acetal such as acetone, methyl ethyl ketone, diisobutyl ketone, dimethyl oxide, diacetone alcohol, cyclohexanone, or methylcyclohexanone.

These solvents dissolve the binder resin and do not need to dissolve the colorant and other components. The colorant and other components may be dispersed in the binder resin solution. The amount of the solvent used is not particularly limited, and the viscosity thereof may be viscosity with which granulation in an aqueous medium may be performed. A ratio of the material containing a binder resin, a colorant, and 5'-chloro-3-hydroxy-2'-methoxy-2-naphthanilide, and other components (former) to the solvent (latter) is preferably from 10/90 to 50/50 (weight ratio of the former/latter) from viewpoints of easy granulation and the final yield of the toner particles.

A solution (toner base solution) of the binder resin, the colorant, and 5'-chloro-3-hydroxy-2'-methoxy-2-naphthanilide, and other components dissolved or dispersed in the solvent is granulated in the aqueous medium containing an inorganic dispersant so as to have a predetermined particle diameter. As the aqueous medium, water is mainly used. A mixing ratio of the aqueous medium and the toner base solution is preferably aqueous medium/base solution=90/10 to 50/50 (weight ratio). As the inorganic dispersant, a material selected from tricalcium phosphate, hydroxyapatite, calcium carbonate, titanium oxide, and silica powder is preferably used. The amount of the inorganic dispersant used is determined according to the particle diameter of the granulated particles, but in general, the amount thereof is preferably from 0.1% by weight to 15% by weight with respect to the toner base solution. When the amount thereof is smaller than 0.1% by weight, the granulation may be difficult to be performed in an excellent manner, and when the inorganic dispersant is used with the amount exceeding 15% by weight, unnecessary fine particles may be formed and desired particles may not be obtained with a high yield.

In order to granulate the toner base solution in the aqueous medium containing the inorganic dispersant in an excellent manner, an auxiliary agent may be added to the aqueous medium. Examples of such an auxiliary agent include well-known cationic, anionic, and nonionic surfactants and an anionic surfactant is particularly preferably used. Examples thereof include sodium alkyl benzene sulfonate, sodium α-olefin sulfonate, and sodium alkyl sulfonate, and these are preferably used in a range of $1\times10^{-4}$% by weight to 0.1% by weight with respect to the toner base solution.

The granulation of the toner base solution in the aqueous medium containing the inorganic dispersant is preferably performed under shearing. The toner base solution dispersed in the aqueous medium is preferably granulated to have an average particle diameter equal to or smaller than 10 μm. The average particle diameter is particularly preferably from 3 μm to 10 μm.

There are various dispersers as a device including a shearing mechanism and a homogenizer is preferably used among them. By using a homogenizer, substances (in the exemplary embodiment, aqueous medium containing the inorganic dispersant and toner base solution) which do not become compatibilized with each other are caused to pass through a gap between a casing and a rotating rotor, to disperse a substances, which do not become compatibilized with certain liquid, in the liquid in a particulate shape. Examples of such a homogenizer include TK homomixer, Line Flow homomixer, an auto homomixer (all manufactured by Tokushu Kika Kogyo Co., Ltd.), a Silverson Homogenizer (manufactured by Silverson), and Polytron homogenizer (manufactured by KINEMATICA (AG)).

The stirring conditions using a homogenizer are preferably set with a circumferential speed of blades of a rotor of equal to or higher than 2 m/sec. When the speed is lower than that, the granulation tends to be performed in an insufficient state. In the exemplary embodiment, the solvent is removed after granulating the toner base solution in the aqueous medium containing the inorganic dispersant. The removal of the solvent may be performed at room temperature (18° C.) with ordinary pressure, but it takes a long time for the removal. Therefore, it is preferable to perform the removal in the temperature conditions with a temperature which is lower than a boiling temperature of the solvent and having a difference from the boiling temperature of 80° C. or lower. The pressure may be ordinary pressure or reduced pressure, but the removal is preferably performed at pressure of 20 mmHg to 150 mmHg when reducing the pressure.

After removing the solvent, it is preferable to wash the toner of the exemplary embodiment with hydrochloric acid or the like. Accordingly, the inorganic dispersant remaining on the surface of the toner particles may be removed and characteristics may be improved by obtaining a composition of the original toner particle. Next, dehydration and drying may be performed to obtain toner particles as powder.

Inorganic oxides, represented by well-known silica, titania, and aluminum oxide, may be added and attached to toner particles obtained by the dissolution suspension method as an external additive for the purpose of adjusting charging properties, and imparting fluidity and charge exchange property, and the like in the same manner as in a case of an emulsion aggregating method. In addition to the inorganic oxide described above, other components (particles) such as a charge-controlling agent, inorganic particles, a lubricant, or an abrasive may be added as external additives.

Electrostatic Charge Image Developer

An electrostatic charge image developer according to the exemplary embodiment includes at least the toner according to the exemplary embodiment.

The electrostatic charge image developer according to the exemplary embodiment may be a single-component developer including only the toner according to the exemplary embodiment, or a two-component developer obtained by mixing the toner with a carrier.

There is no particular limitation to the carrier and examples of the carrier include known carriers. Examples of the carrier include a coated carrier in which the surface of a core made of a magnetic powder is coated with a coating resin; a magnetic powder dispersed carrier in which a magnetic powder is dispersed and blended in a matrix resin; and a resin impregnated carrier in which a porous magnetic powder is impregnated with a resin.

Incidentally, the magnetic powder dispersed carrier and the resin impregnated carrier may be carriers each having the constitutional particle of the carrier as a core and a coating resin coating the core.

Examples of the magnetic powder include magnetic metals such as iron, nickel, and cobalt; and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as conductive particles.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, in order to coat the surface of the core with the resin, a coating method using a coating layer forming solution in which a coating resin and various kinds of additives (used as necessary) are dissolved in an appropriate solvent may be used. The solvent is not particularly limited and may be selected depending on a coating resin to be used and application suitability.

Specific examples of the resin coating method include a dipping method of dipping a core in a coating layer forming solution, a spray method of spraying a coating layer forming solution to the surface of a core, a fluidized-bed method of spraying a coating layer forming solution to a core while the core is suspended by a fluidizing air, and a kneader coater method of mixing a core of a carrier with a coating layer forming solution in a kneader coater, and then removing the solvent.

In the two-component developer, a mixing ratio (weight ratio) of the toner and the carrier is preferably toner: carrier=1:100 to 30:100, and more preferably 3:100 to 20:100.

Image Forming Apparatus and Image Forming Method

An image forming apparatus and an image forming method according to the exemplary embodiment will be described.

The image forming apparatus according to the exemplary embodiment includes an image holding member; a charging unit that charges the surface of the image holding member; an electrostatic charge image forming unit that forms an electrostatic charge image on the surface of the charged image holding member; a developing unit that accommodates an electrostatic charge image developer, and develops the electrostatic charge image formed on the surface of the image holding member as a toner image using the electrostatic charge image developer; a transfer unit that transfers the toner image formed on the surface of the image holding member onto the surface of a recording medium; and a fixing unit that fixes the toner image transferred onto the surface of the recording medium. Further, as the electrostatic charge image developer, the electrostatic charge image developer according to the exemplary embodiment is applied.

In the image forming apparatus according to the exemplary embodiment, an image forming method (an image forming method according to the exemplary embodiment) including a charging step of charging the surface of an image holding member; an electrostatic charge image forming step of forming an electrostatic charge image on the surface of the charged image holding member; a developing step of developing the electrostatic charge image formed on the surface of the image holding member as a toner image using the electrostatic charge image developer according to the exemplary embodiment; a transfer step of transferring the toner image formed on the surface of the image holding member onto the surface of a recording medium; and a fixing step of fixing the toner image transferred onto the surface of the recording medium is carried out.

As the image forming apparatus according to the exemplary embodiment, known image forming apparatuses such as a direct transfer type image forming apparatus which directly transfers a toner image formed on the surface of an image holding member onto a recording medium; an intermediate transfer type image forming apparatus which primarily transfers a toner image formed on the surface of an image holding member onto the surface of an intermediate transfer member and secondarily transfers the toner image transferred on the surface of the intermediate transfer member onto the surface of a recording medium; an image forming apparatus including a cleaning unit which cleans the surface of an image holding member after a toner image is transferred and before charging; and an image forming apparatus including an erasing unit which erases a charge from the surface of an image holding member after a toner image is transferred and before charging by irradiating the surface with easing light is applied.

In the case of the intermediate transfer type apparatus, for example, a configuration in which a transfer unit includes an intermediate transfer member to the surface of which a toner image is transferred, a primary transfer unit which primarily transfers the toner image formed on the surface of the image holding member onto the surface of the intermediate transfer member, and a secondary transfer unit which secondarily transfers the toner image transferred onto the surface of the intermediate transfer member onto the surface of a recording medium is applied.

In the image forming apparatus according to the exemplary embodiment, for example, a portion including the developing unit may have a cartridge structure (process cartridge) which is detachable from the image forming apparatus. As the process cartridge, for example, a process cartridge provided with a developing unit which accommodates the electrostatic charge image developer according to the exemplary embodiment is suitably used.

Hereafter, an example of the image forming apparatus according to the exemplary embodiment will be described, but the invention is not limited thereto. Further, main components shown in the drawing will be described, and the descriptions of the other components will be omitted.

Figure 2:
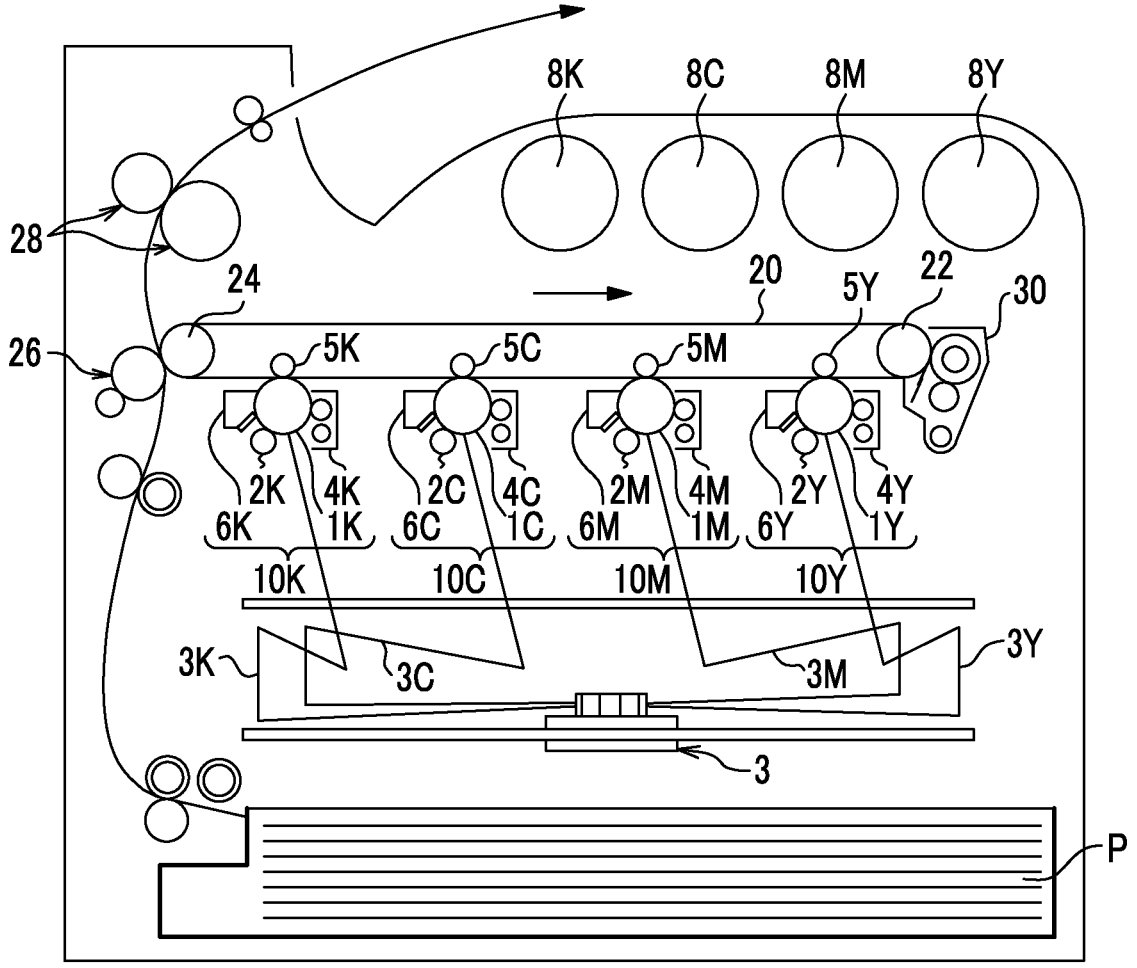
FIG. 2 is a schematic configuration diagram showing an example of an image forming apparatus according to the exemplary embodiment.

FIG. 2 is a schematic diagram showing a configuration of the image forming apparatus according to the exemplary embodiment.

The image forming apparatus shown in FIG. 2 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 is provided through each unit as an intermediate transfer member extending above each of the units 10Y, 10M, 10C, and 10K in the drawing. The intermediate transfer belt 20 is wound around a drive roller 22 and a support roller 24 coming into contact with the inner surface of the intermediate transfer belt 20, which are separated from each other from left to right in the drawing. The intermediate transfer belt 20 travels in a direction from the first unit 10Y to the fourth unit 10K. Incidentally, to the support roller 24, a force is applied in a direction moving away from the drive roller 22 by a spring or the like which is not shown, such that tension is applied to the intermediate transfer belt 20 which is wound around the support roller 24 and the drive roller 22. Further, on the surface of the image holding member side of the intermediate transfer belt 20, an intermediate transfer member cleaning device 30 is provided opposing the drive roller 22.

In addition, toners in the four colors of yellow, magenta, cyan and black, which are accommodated in toner cartridges 8Y, 8M, 8C, and 8K, respectively, are supplied to developing devices (developing units) 4Y, 4M, 4C, and 4K of the units 10Y, 10M, 10C, and 10K, respectively.

Since the first to fourth units 10Y, 10M, 10C, and 10K have the same configuration, the first unit 10Y, which is provided on the upstream side in the travelling direction of the intermediate transfer belt and forms a yellow image, will be described as a representative example. Further, the same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y includes a photoreceptor 1Y functioning as the image holding member. In the surroundings of the photoreceptor 1Y, there are sequentially disposed a charging roller (an example of the charging unit) 2Y for charging the surface of the photoreceptor 1Y to a predetermined potential; an exposure device (an example of the electrostatic charge image forming unit) 3 for exposing the charged surface with a laser beam 3Y based on a color-separated image signal to form an electrostatic charge image; the developing device (an example of the developing unit) 4Y for supplying a charged toner into the electrostatic charge image to develop the electrostatic charge image; a primary transfer roller (an example of the primary transfer unit) 5Y for transferring the developed toner image onto the intermediate transfer belt 20; and a photoreceptor cleaning device (an example of the cleaning unit) 6Y for removing the toner remaining on the surface of the photoreceptor 1Y after the primary transfer.

Further, the primary transfer roller 5Y is disposed inside the intermediate transfer belt 20 and provided in the position facing the photoreceptor 1Y. Further, bias power supplies (not shown), which apply primary transfer biases, are respectively connected to the respective primary transfer rollers 5Y, 5M, 5C, and 5K. A controller (not shown) controls the respective bias power supplies to change the primary transfer biases values which are applied to the respective primary transfer rollers.

Hereafter, the operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by stacking a photosensitive layer on a conductive substrate (volume resistivity at 20° C.: $1\times10^{-6}$ Ω cm or lower). In general, this photosensitive layer has high resistance (resistance similar to that of general resin), and has properties in which, when irradiated with the laser beam 3Y, the specific resistance of a portion irradiated with the laser beam changes. Therefore, the laser beam 3Y is output to the charged surface of the photoreceptor 1Y through the exposure device 3 in accordance with yellow image data sent from the controller not shown. The laser beam 3Y is applied onto the photosensitive layer on the surface of the photoreceptor 1Y, and as a result, an electrostatic charge image having a yellow image pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charge flows on the surface of the photoreceptor 1Y and, in contrast, the charge remains in a portion which is not irradiated with the laser beam 3Y.

The electrostatic charge image which is thus formed on the photoreceptor 1Y is rotated to a predetermined development position along with the traveling, of the photoreceptor 1Y. At this development position, the electrostatic charge image on the photoreceptor 1Y is developed and visualized as a toner image by the developing device 4Y.

The developing device 4Y accommodates, for example, the electrostatic charge image developer, which contains at least a yellow toner and a carrier. The yellow toner is frictionally charged by being stirred in the developing device 4Y to have a charge with the same polarity (negative polarity) as that of a charge on the photoreceptor 1Y and is maintained on a developer roller (as an example of the developer holding member). When the surface of the photoreceptor 1Y passes through the developing device 4Y, the yellow toner is electrostatically attached to a latent image portion from which the charge is erased on the surface of the photoreceptor 1Y, and the latent image is developed with the yellow toner. The photoreceptor 1Y on which a yellow toner image is formed subsequently travels at a predetermined rate, and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y, an electrostatic force directed from the photoreceptor 1Y toward the primary transfer roller 5Y acts upon the toner image, and the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

Meanwhile, the toner remaining on the photoreceptor 1Y is removed and collected by the photoreceptor cleaning device 6Y.

Also, primary transfer biases to be applied respectively to the primary transfer rollers 5M, 5C, and 5K at the second unit 10M and subsequent units, are controlled similarly to the primary transfer bias of the first unit.

In this manner, the intermediate transfer belt 20 having a yellow toner image transferred thereonto from the first unit 10Y is sequentially transported through the second to fourth units 10M, 10C, and 10K, and toner images of respective colors are superimposed and multi-transferred.

The intermediate transfer belt 20 having the four-color toner images multi-transferred thereonto through the first to fourth units arrives at a secondary transfer portion which is configured with the intermediate transfer belt 20, the support roller 24 coming into contact with the inner surface of the intermediate transfer belt and a secondary transfer roller 26 (an example of the secondary transfer unit) disposed on the side of the image holding surface of the intermediate transfer belt 20. Meanwhile, a recording paper P (an example of the recording medium) is supplied to a gap at which the secondary transfer roller 26 and the intermediate transfer belt 20 are brought into contact with each other at a predetermined timing through a supply mechanism and a secondary transfer bias is applied to the support roller 24. The transfer bias applied at this time has the same polarity (−) as the polarity (−) of the toner, and an electrostatic force directing from the intermediate transfer belt 20 toward the recording paper P acts upon the toner image, whereby the toner image on the intermediate transfer belt 20 is transferred onto the recording paper P. Incidentally, on this occasion, the secondary transfer bias is determined depending upon a resistance detected by a resistance detecting unit (not shown) for detecting a resistance of the secondary transfer portion, and the voltage is controlled.

Thereafter, the recording paper P is sent to a press contact portion (nip portion) of a pair of fixing rollers in a fixing device 28 (an example of the fixing unit), and the toner image is fixed onto the recording paper P to form a fixed image.

Examples of the recording paper P onto which the toner image is transferred include plain paper used for electrophotographic copying machines, printers and the like. As the recording medium, other than the recording paper P, OHP sheets may be used.

The surface of the recording paper P is preferably smooth in order to further improve smoothness of the image surface after fixing. For example, coating paper obtained by coating a surface of plain paper with a resin or the like, art paper for printing, and the like are preferably used.

The recording paper P in which fixing of a color image is completed is discharged to an ejection portion, whereby a series of the color image formation operations ends.

Process Cartridge and Toner Cartridge

A process cartridge according to the exemplary embodiment will be described.

The process cartridge according to the exemplary embodiment is a process cartridge which includes a developing unit, which accommodates the electrostatic charge image developer according to the exemplary embodiment and develops an electrostatic charge image formed on an image holding member as a toner image using the electrostatic charge image developer, and is detachable from an image forming apparatus.

Moreover, the configuration of the process cartridge according to the exemplary embodiment is not limited thereto and may include a developing device and, additionally, at least one selected from other units such as an image holding member, a charging unit, an electrostatic charge image forming unit, and a transfer unit, as necessary.

Hereafter, an example of the process cartridge according to the exemplary embodiment will be shown but the process cartridge is not limited thereto. Main components shown in the drawing will be described, and the descriptions of the other components will be omitted.

Figure 3:
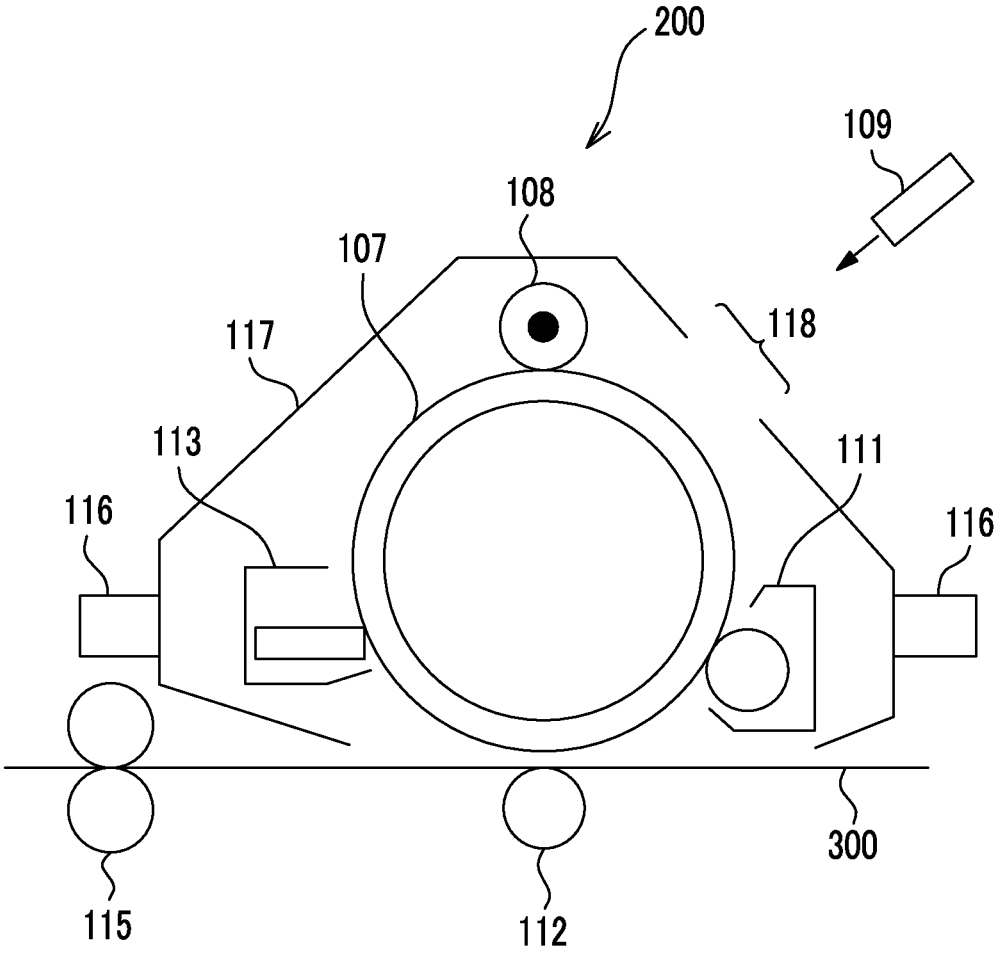
FIG. 3 is a schematic configuration diagram showing an example of a process cartridge according to the exemplary embodiment.

FIG. 3 is a schematic diagram showing a configuration of the process cartridge according to the exemplary embodiment.

A process cartridge 200 shown in FIG. 3 is formed as a cartridge having a configuration in which a photoreceptor 107 (an example of the image holding member), and a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 3, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording paper (an example of the recording medium).

Next, a toner cartridge according to the exemplary embodiment will be described.

The toner cartridge according to the exemplary embodiment accommodates the toner according to the exemplary embodiment and is detachable from an image forming apparatus. The toner cartridge accommodates a toner for replenishment to be supplied to the developing unit provided in the image forming apparatus.

The image forming apparatus shown in FIG. 2 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner accommodated in the toner cartridge runs low, the toner cartridge is replaced.

EXAMPLES

Hereinafter, the exemplary embodiment will be described in detail using examples and comparative examples, but is not limited to these examples. Unless otherwise noted, "parts" and "%" are based on weight.

Example 1

Preparation of Resin Particle Dispersion (1)

Terephthalic acid: 30 parts by mol

Fumaric acid: 70 parts by mol

Ethylene oxide adduct of Bisphenol A: 5 parts by mol

Propylene oxide adduct of Bisphenol A: 95 parts by mol

The above materials are added in a 5-liter flask including a stirrer, a nitrogen gas introducing tube, a temperature sensor, and a rectifying column, the temperature is increased to 220° C. over 1 hour, and 1 part of titanium tetraethoxide is added to 100 parts of the above materials. The temperature is increased to 230° C. over 0.5 hours while distilling away generated water, a dehydration condensation reaction is continued at this temperature for 1 hour, and then the reactant is cooled. By doing so, a polyester resin (1) having a weight average molecular weight of 18,000, an acid value of 15 mgKOH/g, and a glass transition temperature of 60° C. is synthesized.

40 parts of ethyl acetate and 25 parts of 2-butanol are added to a vessel including a temperature adjustment unit and a nitrogen substitution unit to be set as a mixed solvent, 100 parts of the polyester resin (1) is slowly added and dissolved in the mixed solvent, and 10% ammonia aqueous solution (equivalent to three times the amount of the acid value of the resin by a molar ratio) is added thereto and the obtained mixture is stirred for 30 minutes.

Then, the atmosphere in the vessel is substituted with dry nitrogen, the temperature is maintained at 40° C., and 400 parts of ion exchange water is added dropwise thereto at a rate of 2 part/min, while stirring the mixed solution, to perform emulsification. After performing dropwise addition, the temperature of the emulsified solution is returned to room temperature (20° C. to 25° C.), bubbling is performed for 48 hours by dry nitrogen while stirring, to decrease the content of ethyl acetate and 2-butanol to be equal to or smaller than 1,000 ppm, and a resin particle dispersion in which resin particles having a volume average particle diameter of 200 nm are dispersed is obtained. Ion exchange water is added to the resin particle dispersion to adjust solid content to 20% and a resin particle dispersion (1) is obtained.

Preparation of Colorant Particle Dispersion (1)

Magenta pigment: Pigment Red 238 (Permanent Carmine 3810 manufactured by Sanyo Color Works, Ltd.) washed product:
70 parts Anionic surfactant (NEOGEN RK manufactured by Dai-Ichi Kogyo Seiyaku Co., Ltd.): 5 parts Ion exchange water: 200 parts The above materials are mixed with each other and dispersed using a homogenizer (Ultra Turrax T50 manufactured by IKA Japan, K.K.) for 10 minutes. Ion exchange water is added to the dispersion so that the solid content in the dispersion becomes 20% and a colorant particle dispersion (1) in which colorant particles having a volume average particle diameter of 160 nm are dispersed is obtained.

Preparation of Release Agent Particle Dispersion

Paraffin Wax (HNP-9 manufactured by Nippon Seiro Co., Ltd.):
100 parts

Anionic surfactant (NEOGEN RK manufactured by Dai-Ichi Kogyo Seiyaku Co., Ltd.): 1 part Ion exchange water: 350 parts The above materials are mixed with each other, heated to 100° C., and dispersed using a homogenizer (Ultra Turrax T50 manufactured by IKA Japan, K.K.). After that, the mixture is subjected to dispersion treatment with Manton-Gaulin high pressure homogenizer (manufactured by Gaulin Co., Ltd.), and a release agent particle dispersion (solid content of 20%) in which release agent particles having a volume average particle diameter of 200 nm are dispersed is obtained.

Preparation of Toner Particles

Resin particle dispersion (1): 420 parts

Colorant particle dispersion (1): 25 parts

Release agent particle dispersion: 50 parts

Naphthol AS-CA (5'-chloro-3-hydroxy-2'-methoxy-2-naphthanilide): 0.005 parts 3-amino-4-methoxybenzanilide: 0.03 parts Anionic surfactant (TaycaPower): 2 parts The above materials are put into the round stainless steel flask, 0.1 N of nitric acid is added to adjust the pH to 3.5, and then, 30 parts of a nitric acid aqueous solution containing polyaluminum chloride at a concentration of 10% is added. Then, the resultant material is dispersed at 30° C. using a homogenizer (Ultra Turrax T50 manufactured by IKA Japan, K.K.), heated to 45° C. in a heating oil bath and the temperature is maintained for 30 minutes. After that, 100 parts of the resin particle dispersion (1) are added thereto and the obtained mixture is maintained for 1 hour. After adjusting the pH to 8.5 by adding 0.1 N sodium hydroxide aqueous solution, the temperature is increased to 85° C. while continuing the stirring, and maintained for 5 hours. Then, the temperature is decreased to 20° C. at a rate of 20° C./min, the resultant material is filtered, sufficiently washed with ion exchange water, and dried, to obtain toner particles (1) having a volume average particle diameter of 7.5 μm.

Preparation of Toner 100 parts of the toner particles (1) and 1.0 part of dimethyl silicone oil-treated silica particles (RY 200 manufactured by Nippon Aerosil co. Ltd.) are mixed with each other using a Henschel mixer, and toner (1) is obtained. The amount of Naphthol AS-CA in the toner (1) is 50 ppm.

Preparation of Developer

Ferrite particles (average particle diameter of 50 μm):
100 parts

Toluene: 14 parts

Styrene-methyl methacrylate copolymer (copolymerization ratio of 15/85): 3 parts Carbon black: 0.2 parts The above components excluding the ferrite particles are dispersed by a sand mill to prepare dispersion, this dispersion and the ferrite particles are put into a vacuum degassing type kneader, dried while stirring under the reduced pressure, and a carrier is obtained.

8 parts of the toner (1) is mixed with 100 parts of the carrier, and a developer (1) is obtained.

Evaluation

The following evaluation is performed using the developer (1). The results are shown in Table 1.

The following operation and the image formation are performed in the environment of a temperature of 25° C. and a humidity of 60%.

As an image forming apparatus which forms an image for evaluation, ApeosPort IV C4470 manufactured by Fuji Xerox Co., Ltd. is prepared, and the developer is put into a developing device, and replenishment toner (same toner as the toner contained in the developer) is added to a toner cartridge. Then, a 5 cm×5 cm-sized magenta solid image having an image area ratio of 100% and a 5 cm×5 cm-sized image having an image area ratio of 50% are formed on coated paper (JD COAT manufactured by Fuji Xerox Co., Ltd., product name: JD COAT 127, basis weight: 127 g/m$^2$, thickness: 140 μm), and 100 sheets are continuously printed. The following evaluation is performed with respect to the obtained image on the 100th sheet.

Density

The density is evaluated for the obtained 5 cm×5 cm-sized solid images having an image area ratio of 100% on the 100th sheet. The density of the magenta image is measured using a reflection spectral densitometer (product name: Xrite-939 manufactured by X-Rite, Inc.). The density equal to or greater than 1.4 is set as an acceptable range.

Evaluation of Gradation Properties

The density is evaluated for the obtained 5 cm×5 cm-sized solid images having an image area ratio of 100% on the 100th sheet and 5 cm×5 cm-sized images having an image area ratio of 50% on the 100th sheet. The difference in density is set as gradation properties and the evaluation is performed based on the following criteria. The density of the magenta image is measured using a reflection spectral densitometer (product name: Xrite-939 manufactured by X-Rite, Inc.). The difference in density being smaller than 0.95 is set as an acceptable range.

Evaluation of Anti-Crease Strength of Image

The anti-crease strength of an image is evaluated for the obtained 5 cm×5 cm-sized solid images having an image area ratio of 100% on the 100th sheet. The sheet on which the solid image is formed is folded and unfolded once, the folded image part is wiped with cotton, and a white line width (μm) of the image is measured. The white line width equal to or smaller than 40 μm is set as an acceptable range.

In the following examples and comparative examples, the evaluation of anti-crease strength of an image is not performed for the toners which have deteriorated results in the evaluation of the density and the gradation properties.

Example 2

A toner and a developer are prepared in the same manner as in Example 1, except for changing the amount of the resin particle dispersion (1) to 440 parts and the amount of the colorant particle dispersion (1) to 5 parts from the amounts used in the preparation of the toner particles of Example 1.

Example 3

A toner and a developer are prepared in the same manner as in Example 1, except for changing the amount of the resin particle dispersion (1) to 345 parts and the amount of the colorant particle dispersion (1) to 100 parts from the amounts used in the preparation of the toner particles of Example 1.

Example 4

A toner and a developer are prepared in the same manner as in Example 1, except for changing the amount of Naphthol AS-CA to 0.0001 parts from the amounts used in the preparation of the toner particles of Example 1.

Example 5

A toner and a developer are prepared in the same manner as in Example 1, except for changing the amount of Naphthol AS-CA to 0.03 parts from the amount used in the preparation of the toner particles of Example 1.

Example 6

A toner and a developer are prepared in the same manner as in Example 1, except for changing the amount of 3-amino-4-methoxybenzanilide to 0.0001 parts from the amount used in the preparation of the toner particles of Example 1.

Example 7

A toner and a developer are prepared in the same manner as in Example 1, except for changing the amount of 3-amino-4-methoxybenzanilide to 0.1 parts from the amount used in the preparation of the toner particles of Example 1.

Example 8

Preparation of Colorant Particle Dispersion (2)

Magenta pigment: Pigment Red 122 (manufactured by Dainichiseika Color & Chemicals Mfg. Co., Ltd.): 70 parts
Anionic surfactant (NEOGEN RK manufactured by Dai-Ichi Kogyo Seiyaku Co., Ltd.): 5 parts
Ion exchange water: 200 parts The above materials are mixed with each other and dispersed using a homogenizer (Ultra Turrax T50 manufactured by IKA Japan, K.K.) for 10 minutes. Ion exchange water is added to the dispersion so that the solid content in the dispersion becomes 20% and a colorant particle dispersion (2) in which colorant particles having a volume average particle diameter of 160 nm are dispersed is obtained.

A toner and a developer are prepared in the same manner as in Example 1, except for changing the amount of the resin particle dispersion (1) to 395 parts and using 25 parts of the colorant particle dispersion (2) instead of 25 parts of the colorant particle dispersion (1) used in the preparation of the toner particles of Example 1.

Example 9

Preparation of Toner Particles

Polyester resin: 84 parts
Magenta pigment: Pigment Red 238 (Permanent Carmine 3810 manufactured by Sanyo Color Works, Ltd.) washed product:
5 parts
Paraffin Wax (HNP-9 manufactured by Nippon Seiro Co., Ltd.):
10 parts
Naphthol AS-CA (5'-chloro-3-hydroxy-2'-methoxy-2-naphthanilide): 0.005 parts
3-amino-4-methoxybenzanilide: 0.03 parts The above materials are kneaded by an extruder and pulverized by a surface pulverization-type pulverizer, fine particles and coarse particles are classified by a wind classifier, and toner particles (9) having a volume average particle diameter of 7.5 μm are obtained. After that, a toner and a developer are prepared by the same method as in Example 1.

Example 10

Preparation of Colorant Particle Dispersion (3)
Magenta pigment: Pigment Red 238 (Permanent Carmine 3810 manufactured by Sanyo Color Works, Ltd.) washed product:
20 parts
Ethyl acetate: 80 parts The above materials are dispersed using a sand mill and a colorant particle dispersion (3) is obtained.

Preparation of Release Agent Particle Dispersion
Paraffin Wax (HNP-9 manufactured by Nippon Seiro Co., Ltd.):
20 parts
Ethyl acetate: 80 parts The above materials are dispersed using a DCP mill in a cooled state at 10° C., and a release agent particle dispersion is obtained.

Preparation of Oil-Phase Solution
Polyester resin: 84 parts
Colorant particle dispersion (3): 25 parts
Release agent particle dispersion: 50 parts
Ethyl acetate: 325.6 parts
Naphthol AS-CA (5'-chloro-3-hydroxy-2'-methoxy-2-naphthanilide): 0.005 parts
3-amino-4-methoxybenzanilide: 0.03 parts The above materials are mixed with each other and stirred to obtain an oil-phase solution.

Preparation of Water-Phase Solution
Calcium carbonate dispersion (calcium carbonate: water=40 parts: 60 parts): 124 parts
2% aqueous solution of CELLOGEN BS-H (manufactured by Dai-Ichi Kogyo Seiyaku Co., Ltd.): 99 parts
Water: 277 parts The above materials are mixed with each other and stirred to obtain a water-phase solution.

Preparation of Toner Particles 500 parts of the oil-phase solution and 500 parts of the water-phase solution are mixed with each other and stirred to obtain a suspension and this suspension is stirred by a propeller-type stirrer for 48 hours to remove the solvent. Next, after adding hydrochloric acid and removing calcium carbonate, the resultant material is washed with water, dried, and classified, and toner particles (10) having a volume average particle diameter of 7.5 μm are obtained. After that, a toner and a developer are prepared by the same method as in Example 1.

Example 11

A toner and a developer are prepared in the same manner as in Example 1, except for changing the amount of 3-amino-4-methoxybenzanilide to 0 parts from the amount used in the preparation of the toner particles of Example 1.

Example 12

A toner and a developer are prepared in the same manner as in Example 1, except for changing the amount of Naphthol AS-CA to 0.0001 parts and the amount of 3-amino-4-methoxybenzanilide to 0 parts from the amounts used in the preparation of the toner particles of Example 1.

Example 13

A toner and a developer are prepared in the same manner as in Example 1, except for changing the amount of Naphthol AS-CA to 0.03 parts and the amount of 3-amino-4-methoxybenzanilide to 0 parts from the amounts used in the preparation of the toner particles of Example 1.

Comparative Example 1

A toner and a developer are prepared in the same manner as in Example 1, except for changing the amount of the resin particle dispersion (1) to 441 parts and the amount of the colorant particle dispersion (1) to 4 parts from the amounts used in the preparation of the toner particles of Example 1.

Comparative Example 2

A toner and a developer are prepared in the same manner as in Example 1, except for changing the amount of the resin particle dispersion (1) to 344 parts and the amount of the colorant particle dispersion (1) to 101 parts from the amounts used in the preparation of the toner particles of Example 1.

Comparative Example 3

A toner and a developer are prepared in the same manner as in Example 1, except for changing the amount of Naphthol AS-CA to 0.00008 parts from the amount used in the preparation of the toner particles of Example 1.

Comparative Example 4

A toner and a developer are prepared in the same manner as in Example 1, except for changing the amount of Naphthol AS-CA to 0.035 parts from the amount used in the preparation of the toner particles of Example 1.

Comparative Example 5

A toner and a developer are prepared in the same manner as in Example 1, except for changing Naphthol AS-CA used in the preparation of the toner particles of Example 1 to 3-hydroxy-2-naphthanilide.

TABLE 1

| | Colorant % by weight | Rate of Pigment Reds 238 and 269 % by weight | Component 1 ppm | Component 2 ppm | Anti-crease strength | Image density | Gradation properties |
|---|---|---|---|---|---|---|---|
| Example 1 | 5 | 100 | 50 | 300 | 10 | 1.68 | 0.84 |
| Example 2 | 1 | 100 | 50 | 300 | 30 | 1.40 | 0.89 |
| Example 3 | 20 | 100 | 50 | 300 | 30 | 1.92 | 0.94 |
| Example 4 | 5 | 100 | 1 | 300 | 35 | 1.65 | 0.90 |
| Example 5 | 5 | 100 | 300 | 300 | 20 | 1.66 | 0.94 |
| Example 6 | 5 | 100 | 50 | 1 | 30 | 1.64 | 0.91 |
| Example 7 | 5 | 100 | 50 | 1,000 | 20 | 1.67 | 0.94 |
| Example 8 | 5 | 50 | 50 | 300 | 20 | 1.72 | 0.90 |
| Example 9 | 5 | 100 | 50 | 300 | 10 | 1.68 | 0.85 |
| Example 10 | 5 | 100 | 50 | 300 | 10 | 1.68 | 0.85 |
| Example 11 | 5 | 100 | 50 | 0 | 35 | 1.63 | 0.90 |
| Example 12 | 5 | 100 | 1 | 0 | 40 | 1.62 | 0.91 |
| Example 13 | 5 | 100 | 300 | 0 | 40 | 1.62 | 0.92 |
| Comparative Example 1 | 0.8 | 100 | 50 | 300 | — | 1.38 | 0.91 |
| Comparative Example 2 | 20.2 | 100 | 50 | 300 | — | 1.90 | 0.98 |
| Comparative Example 3 | 5 | 100 | 0.8 | 300 | 45 | 1.64 | 0.91 |
| Comparative Example 4 | 5 | 100 | 350 | 300 | — | 1.65 | 0.99 |
| Comparative Example 5 | 5 | 100 | 50 | 300 | 45 | 1.62 | 0.94 |

In Table 1, a column of the "Colorant" indicates the "content of the colorant", a column of the "Rate of Pigment Reds 238 and 269" indicates the "rate of the content of Pigment Red 238 and Pigment Red 269 occupying the colorant", a column of the "Component 1" indicates the "Content of 5'-chloro-3-hydroxy-2'-methoxy-2-naphthanilide", and a column of the "Component 2" indicates the "Content of 3-amino-4-methoxybenzanilide". In addition, the column of the "Component 1" of Comparative Example 5 indicates the "content of 3-hydroxy-2-naphthanilide". Further, "–" in a column of the "anti-crease strength" indicates that the evaluation of the anti-crease strength is not executed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising toner particles including:

a binder resin;

a colorant; and

5'-chloro-3-hydroxy-2'-methoxy-2-naphthanilide, wherein the colorant contains at least one of Pigment Red 238 and Pigment Red 269, a content of the colorant is from 5% by weight to 20% by weight, and a content of 5'-chloro-3-hydroxy-2'-methoxy-2-naphthanilide is from 1 ppm to 300 ppm based on the weight.

2. The electrostatic charge image developing toner according to claim 1, wherein a rate of a content of Pigment Red 238 and Pigment Red 269 occupying the colorant is from 50% by weight to 100% by weight.

3. The electrostatic charge image developing toner according to claim 1, wherein the toner particles further includes 3-amino-4-methoxybenzanilide in an amount of from 1 ppm to 1,000 ppm based on the weight.

4. The electrostatic charge image developing toner according to claim 1, wherein the toner particles have a volume average particle diameter of from 4 μm to 8 μm.

5. The electrostatic charge image developing toner according to claim 1, wherein the toner particles have a shape factor of from 120 to 140.

6. The electrostatic charge image developing toner according to claim 1, wherein a viscosity of the toner particles at 100° C. is from 5,000 Pa·s to 50,000 Pa·s.

7. An electrostatic charge image developer comprising the electrostatic charge image developing toner according to claim 1.

8. A toner cartridge that accommodates the electrostatic charge image developing toner according to claim 1, wherein the toner cartridge is configured to be detachable from an image forming apparatus.

9. The electrostatic charge image developing toner according to claim 1, wherein the content of 5'-chloro-3-hydroxy-2'-methoxy-2-naphthanilide is from 10 ppm to 300 ppm based on the weight.

10. The electrostatic charge image developing toner according to claim 1, wherein the content of 5'-chloro-3-hydroxy-2'-methoxy-2-naphthanilide is from 50 ppm to 300 ppm based on the weight.

11. The electrostatic charge image developing toner according to claim 10, wherein the toner particles further include 3-amino-4-methoxybenzanilide in a content of from 10 ppm to 500 ppm based on the weight.

12. The electrostatic charge image developing toner according to claim 1, wherein the content of 5'-chloro-3-hydroxy-2'-methoxy-2-naphthanilide is from 50 ppm to 200 ppm based on the weight.

13. The electrostatic charge image developing toner according to claim 1, wherein the content of 5'-chloro-3-hydroxy-2'-methoxy-2-naphthanilide is from 50 ppm to 100 ppm based on the weight.

14. The electrostatic charge image developing toner according to claim 13, wherein the toner particles further include 3-amino-4-methoxybenzanilide in a content of from 10 ppm to 500 ppm based on the weight.

15. The electrostatic charge image developing toner according to claim 1, wherein the toner particles further include 3-amino-4-methoxybenzanilide in a content of from 5 ppm to 800 ppm based on the weight.

16. The electrostatic charge image developing toner according to claim 1, wherein the toner particles further include 3-amino-4-methoxybenzanilide in a content of from 10 ppm to 500 ppm based on the weight.

17. The electrostatic charge image developing toner according to claim 1, wherein the content of the colorant is from 5% by weight to 15% by weight.

* * * * *